US005622425A

United States Patent [19]

Lin

[11] Patent Number: 5,622,425

[45] Date of Patent: *Apr. 22, 1997

[54] MINIATURE LIGHT SET

[76] Inventor: Te H. Lin, 5F, No. 38, Lane 1050, Ming-Hoo Rd., HsinChu City, Taiwan

[ * ] Notice: The term of this patent shall not extend beyond the expiration date of Pat. No. 5,339,232.

[21] Appl. No.: 481,471

[22] PCT Filed: Jan. 12, 1994

[86] PCT No.: PCT/US94/00673

§ 371 Date: Jun. 12, 1995

§ 102(e) Date: Jun. 12, 1995

[87] PCT Pub. No.: WO94/16480

PCT Pub. Date: Jul. 21, 1994

Related U.S. Application Data

[63] Continuation-in-part of Ser. No. 3,454, Jan. 12, 1993, Pat. No. 5,339,232.

[51] Int. Cl.[6] ..... F21V 21/00

[52] U.S. Cl. ..... 362/249; 362/226; 362/391; 439/419

[58] Field of Search ..... 362/391, 226, 362/249, 252, 806, 407; 439/414, 419, 505, 417, 686, 694

[56] References Cited

U.S. PATENT DOCUMENTS

| | | | |
|---|---|---|---|
| 4,631,650 | 12/1986 | Ahroni | 362/249 |
| 4,777,573 | 10/1988 | Liao | 362/249 |
| 4,779,177 | 10/1988 | Ahroni | 362/249 |
| 4,999,751 | 3/1991 | Chen | 362/226 |
| 5,121,310 | 6/1992 | Ahroni | 362/226 |

*Primary Examiner*—Ira S. Lazarus
*Assistant Examiner*—Thomas M. Sember
*Attorney, Agent, or Firm*—Larson and Taylor

[57] ABSTRACT

A miniature light set comprises lamps, lamp bases, lamp holders and a ribbon cord with three or more wires. Each of the lamp holders has a socket at one end which receives a lamp base and a wireway at the opposite end. The wireway has two upstanding elongate walls which define an elongate channel for receiving the ribbon cord, and has a transverse pressing bar at each end of the channel. A pair of conductor plates are positioned in a bulb socket into which a lamp can be inserted with the lamp lead wires in contact with the plates. The other ends of the conductor plates project into the wireway and make contact with conductors in corresponding stripped portions of the wires. On the underside of a cover base are two press bits which are located between the lampholder pressing bars when the cover is installed. With the location of the snap-on cover on the lampholder, the cord is bent and retained by the pressing bits of the snap-on cover and the pressing bars of the wireway.

39 Claims, 11 Drawing Sheets

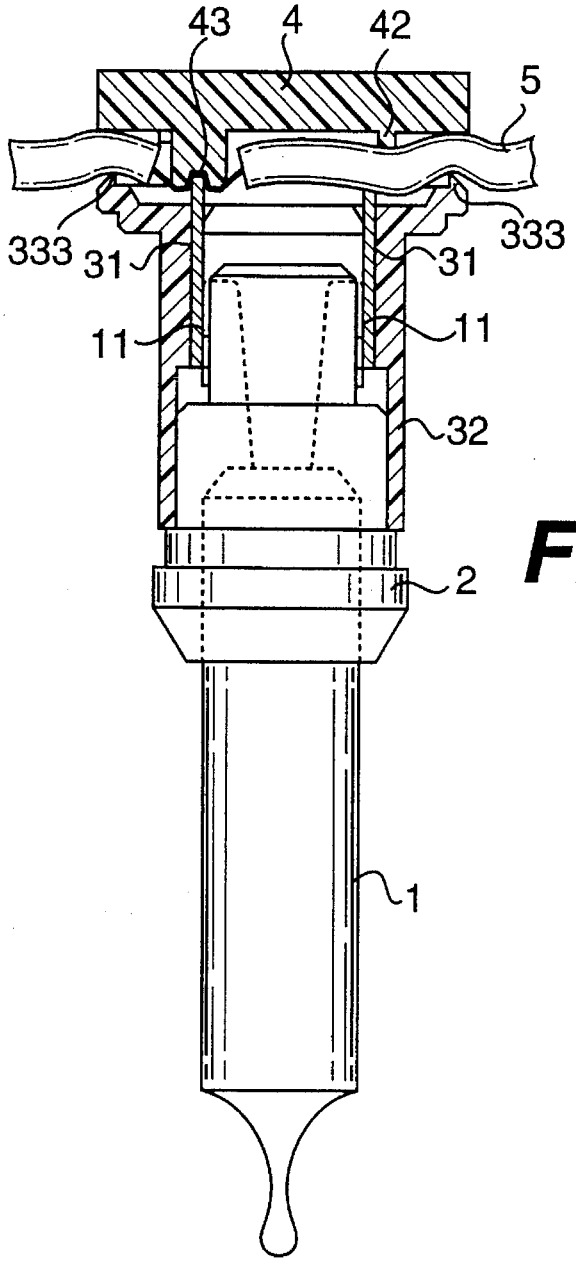
FIG. 6
FIG. 6A
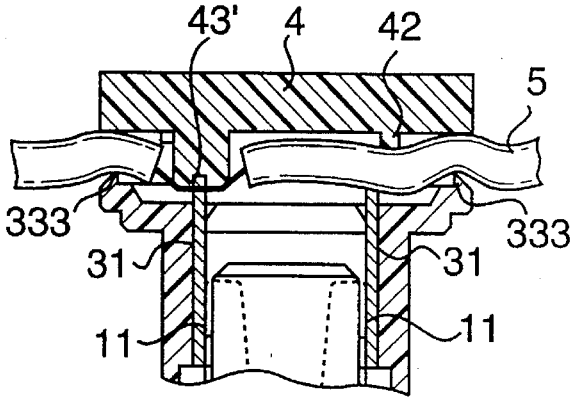

FIG. 11
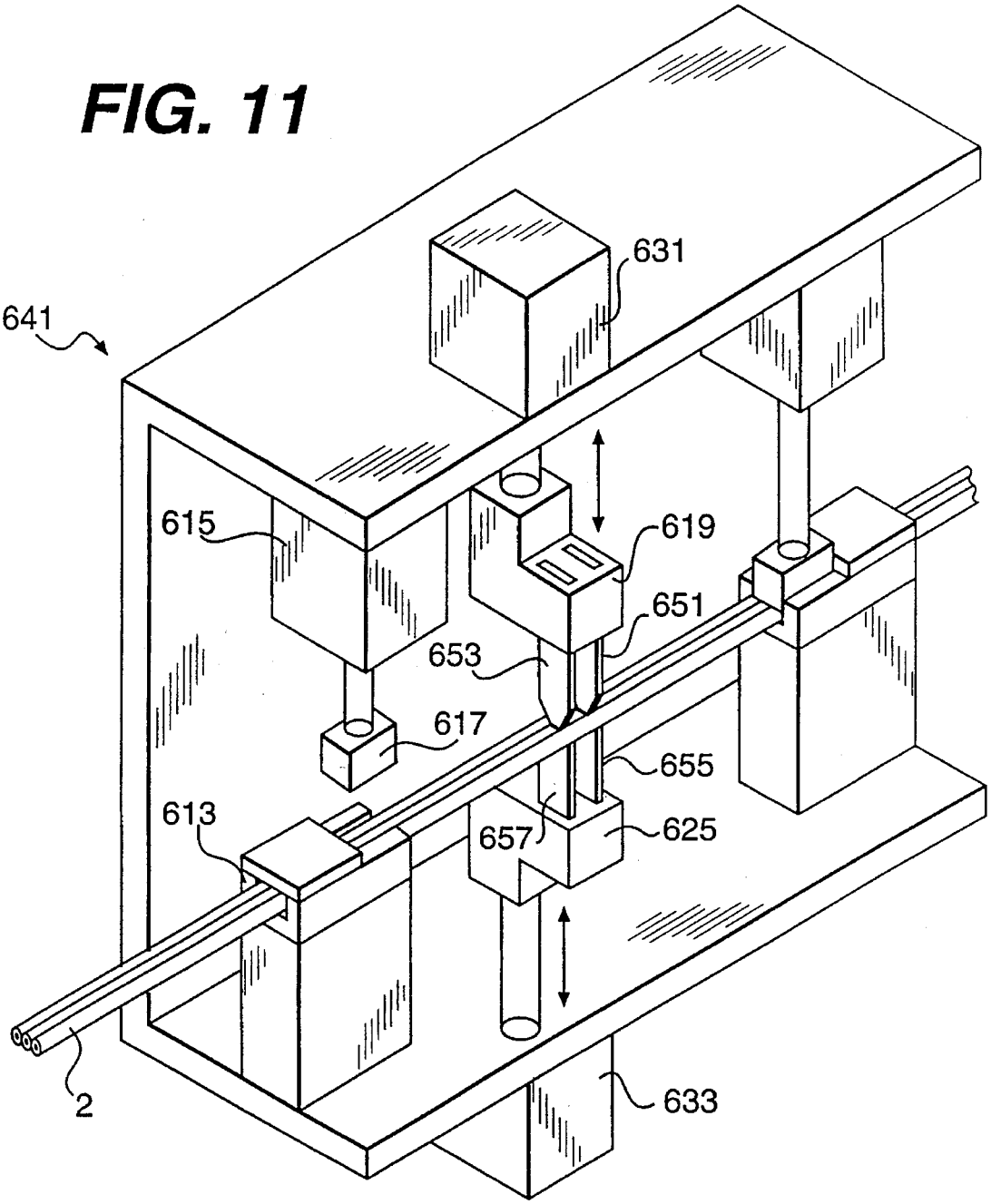
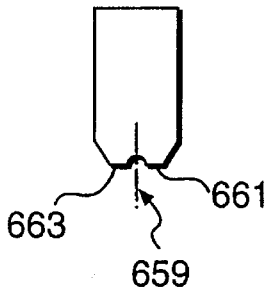
FIG. 12a
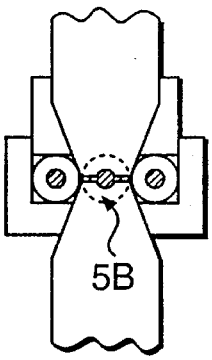
FIG. 12b

FIG. 15
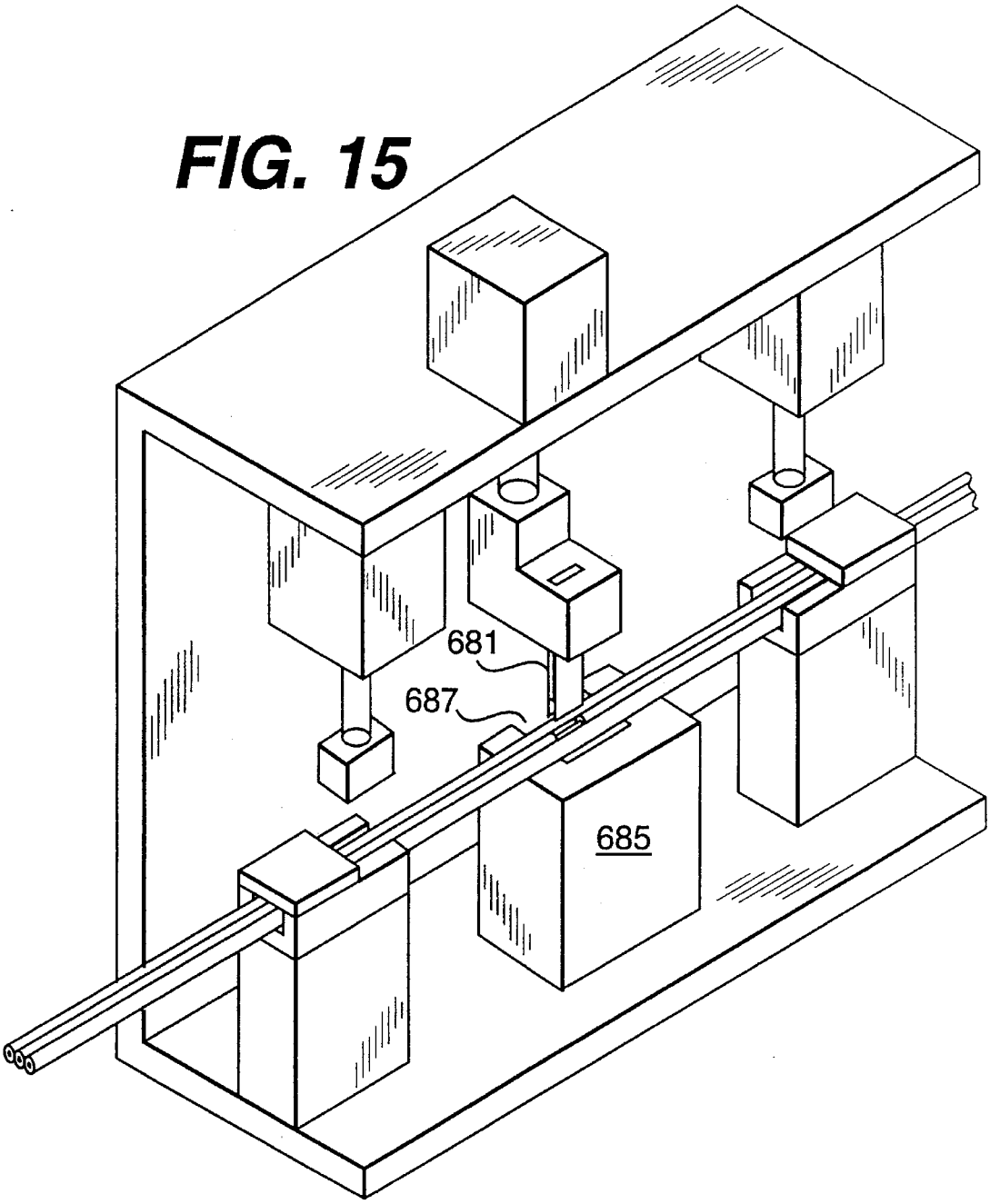
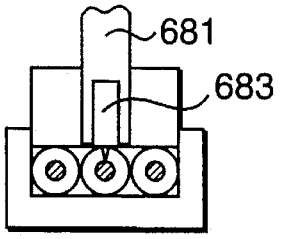
FIG. 16a
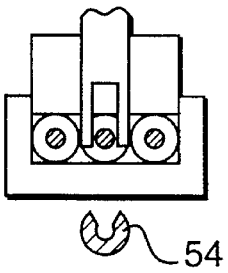
FIG. 16b

MINIATURE LIGHT SET

RELATIONSHIP TO OTHER APPLICATIONS

This application is a Continuation-In-Part application of application Ser. No. 08/003,454 filed Jan. 12, 1993, now U.S. Pat. No. 5,339,232.

FIELD OF THE INVENTION

The present invention relates in general to light sets and relates in particular to miniature light sets incorporating a combined parallel and serial circuit design, and to a method and apparatus for manufacturing such light sets.

BACKGROUND OF THE INVENTION

Conventionally a light set is manufactured as a bundle of interwoven wires with a plurality of lampholders containing lamps electrically and physically mounted at suitable locations along the bundle of wires. Manufacturing the light set in this way requires a lot of time and labor and the resulting overall appearance is not very good. The lampholder in this type of light set also requires an interactive connection between the terminals and the wires which means that there is more than one constraint to consider in the circuit design. This constraint defeats the usefulness of the feature. Finally, because each lampholder is connected in series, the failure of any one lampholder or lamp in the entire light string will result in the failure, inoperability and extinguishment of the entire light set.

In view of the foregoing shortcomings, there have been some improvements developed by the industry. For example, Taiwan patent application number 7,329,609 filed suggests the use of an integrated cord to serve the purpose of connecting the wire through the lamp. It also suggested the use of a lampholder having a base with a bottom opening and an end cover with metal prongs or pikes on it. During assembly the wire is passed through the lampholder base and the end cover is installed so that the prongs penetrate specifically furnished insulation layers on the cord and contact the metal conductor core to make the electrical connection.

However, the lamp set of the Taiwan patent application still suffers from a number of deficiencies. Because the operability of the miniature light circuit depends upon the penetration of the metal pikes into the enclosed conductor, there is often a question as to the satisfaction of the requirements of stability and reliability. Indeed, in the packing or operation of such miniature light strings, if the cord is subjected to repeated bending or folding near a lampholder, the string will very often suffer a poor conductivity between the pikes and the core conductor.

Also, according to the circuit design of the Taiwanese patent application, the lamp set is comprised of a parallel connection of a plurality of strings of lamps connected in series. Thus, the burning out of any one particular lamp will not result in the total inoperability of all of the remaining lamps. However, there is also no denying that when one particular lamp of any string fails, all of the other bulbs in that string will also be extinguished.

SUMMARY OF THE INVENTION

Recognizing the deficiencies and drawbacks of the conventional lamp string or light set assemblies, the present inventor has betaken of himself to obtain further improvements.

The present invention incorporates several principals and features. It utilizes the parallel-series circuit design to ensure the trouble-free functioning of the light set. Even though one lampholder may fail or a bulb becomes loose or burns out in one of the series strings, all the other lamps in the other strings will continue operating unaffected as usual. The present invention also utilizes wires in which the insulation layer is stripped off to expose the central conductor at those locations corresponding to the location of the conductor plates of the lampholder. Thus the conductivity of the circuit is completely assured by utilizing close contact between the stripped portion of the wires and the conductor plates. In addition the correlation between the lampholder and the corresponding elements to be retained therein has been optimized such that the conductor plates can be reliably and dependably physically forced into contact with the stripped portion of the wires. This results in the elimination of any poor electrical contact and assures good conductivity even if the wire is exposed to repeated bending or folding, or other abuses.

These and further features and advantages of the present invention will be described in greater detail and will be better appreciated by referring to the accompanying drawings and the descriptions set forth hereinbelow.

BRIEF DESCRIPTION OF THE DRAWINGS

FIG. 6 is a front elevational view, partly in cross section, of the assembled lampholder depicted in FIG. 1.

FIG. *6a* is a front elevational view, partly in cross section, of an alternative embodiment of an assembled lampholder.

Figure 7:
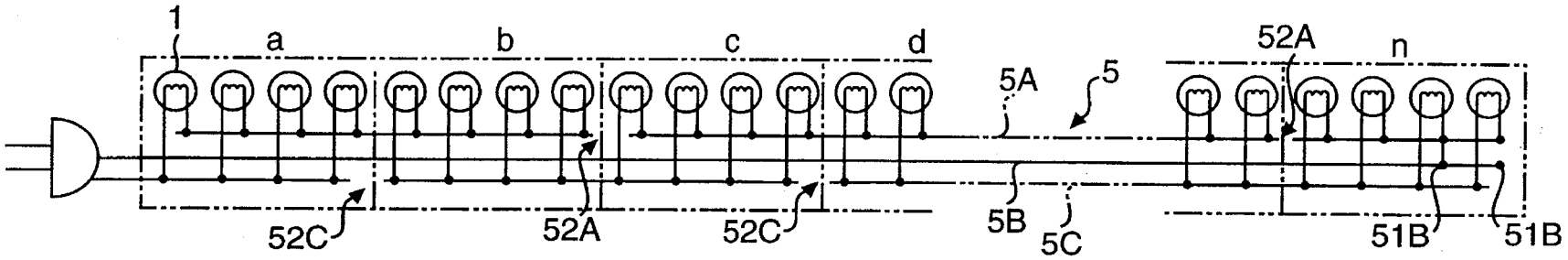

FIG. 7 is an electrical schematic of the circuitry of the present invention.

Figure 8:
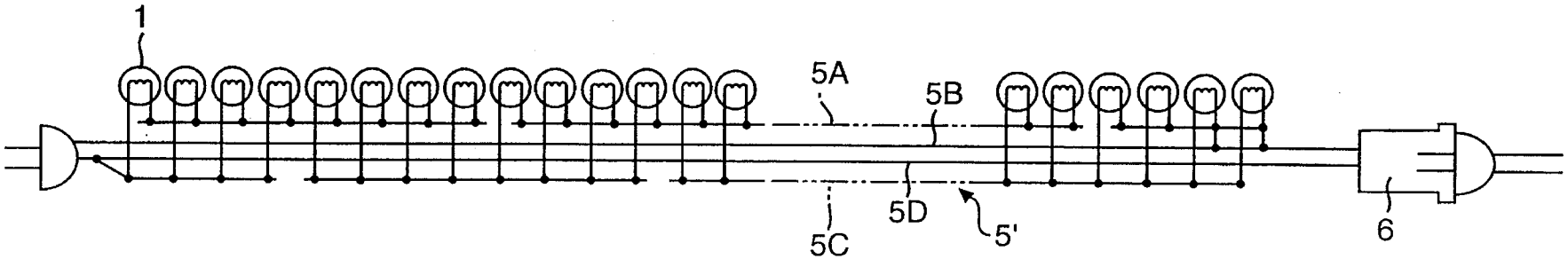

FIG. 8 is an alternative embodiment of the electrical schematic of the circuitry depicted in FIG. 7.

Figure 9:
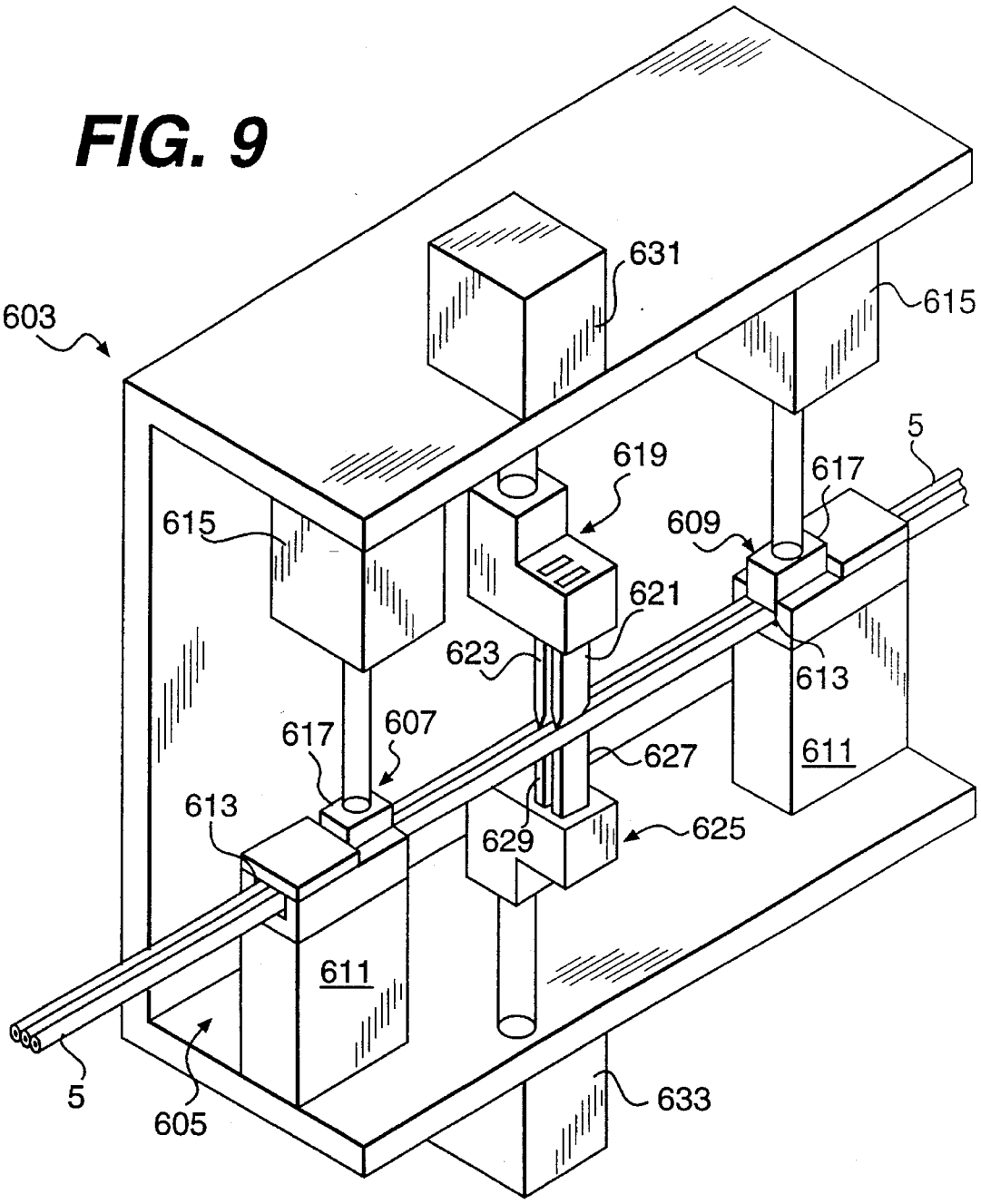

FIG. 9 is a schematic perspective view of a first station of a machine for stripping off the insulation at selective locations on selective wires, a particular wire being separated at this particular station.

Figure 10:
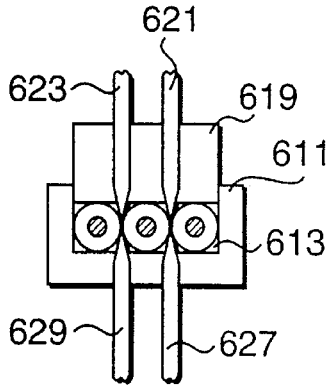

FIG. 10 is a schematic cross-sectional end view showing the cutters separating the wires.

FIG. 11 is a schematic perspective view of a second station of the stripping machine, the insulation of a particular wire being circularly cut at this particular station.

FIG. 12 is a schematic cross-sectional end view showing one of the cutters cutting into the wire insulation without cutting the center conductor.

FIG. **12*a* is an enlarged schematic elevational view of the cutting blade of FIG. 12**.

Figure 13:
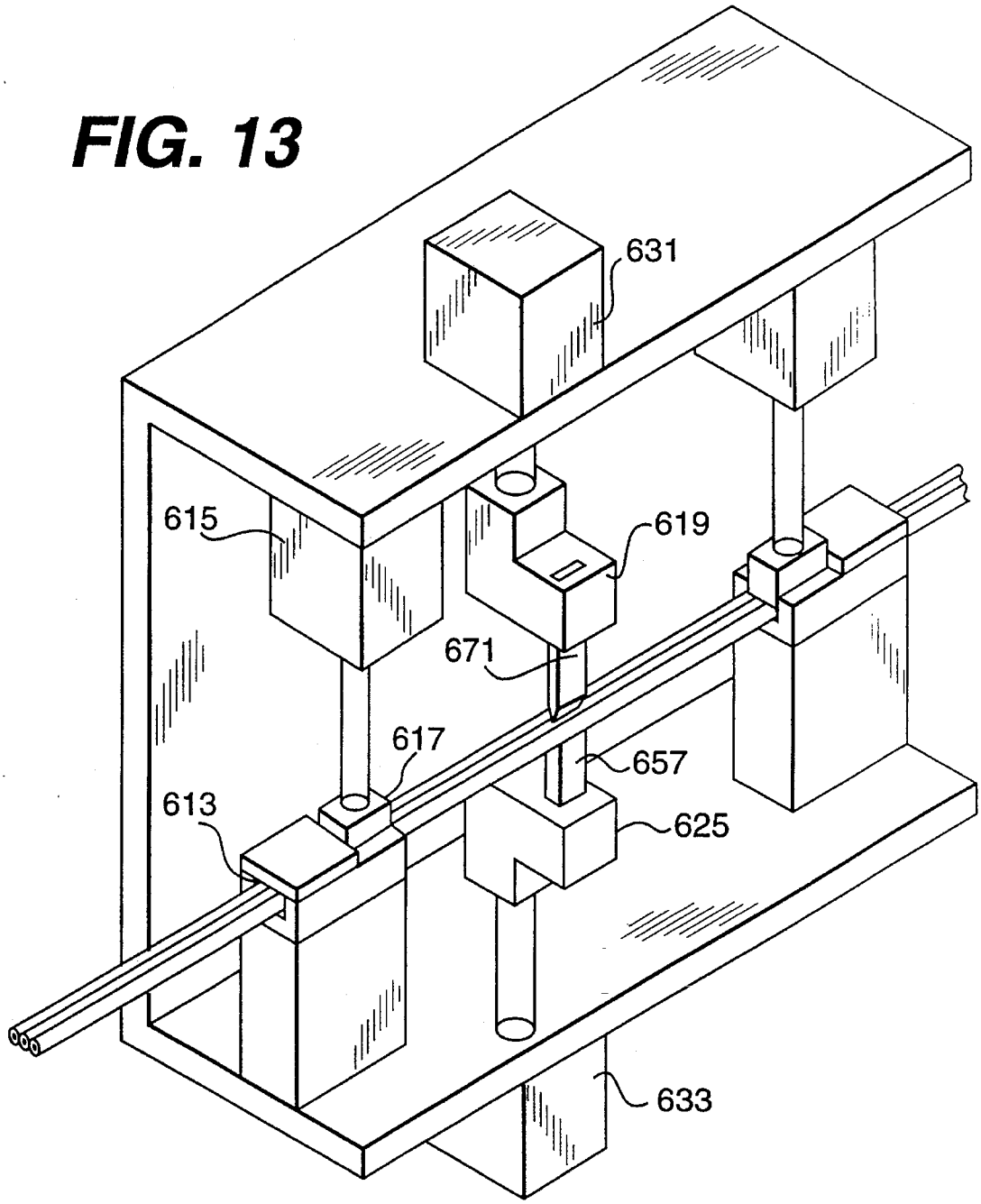

FIG. 13 is a schematic perspective view of a third station of the stripping machine, the insulation of a particular wire being axially or longitudinally cut at this particular station.

Figure 14:
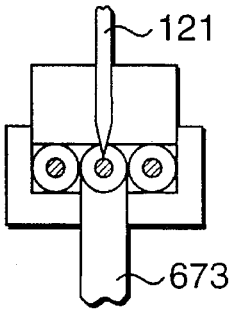

FIG. 14 is a schematic cross-sectional end view showing the cutter cutting the length of insulation between the two circular cuts.

FIG. 15 is a schematic perspective view of a fourth station of the stripping machine, the insulation of the wire being removed at this particular station.

FIGS. 16*a* and 16*b* are schematic cross-sectional end views showing the steps in removing the cut insulation section from the selected wire without affecting the other two wires.

Figure 3:
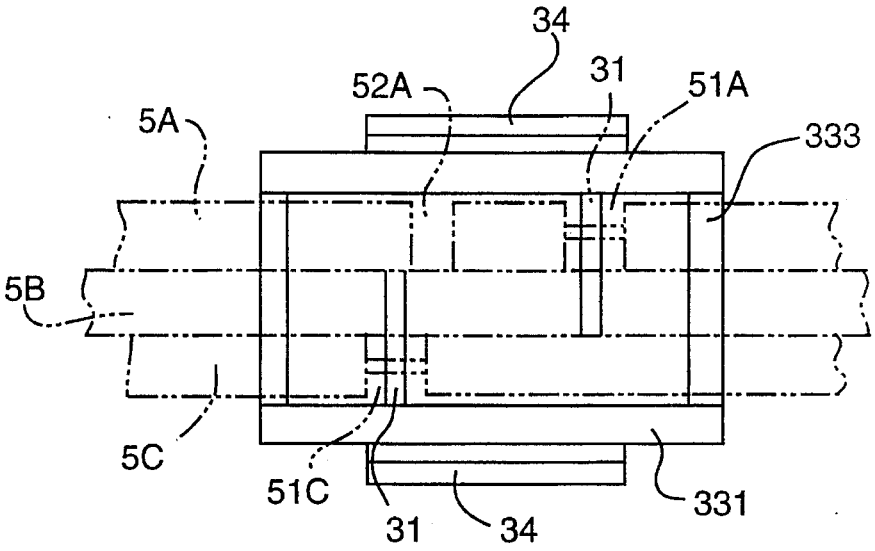
FIG. 3 is a top plan view of the wireway of the lampholder depicting in phantom the position of a ribbon cord containing three wires.
Figure 17:
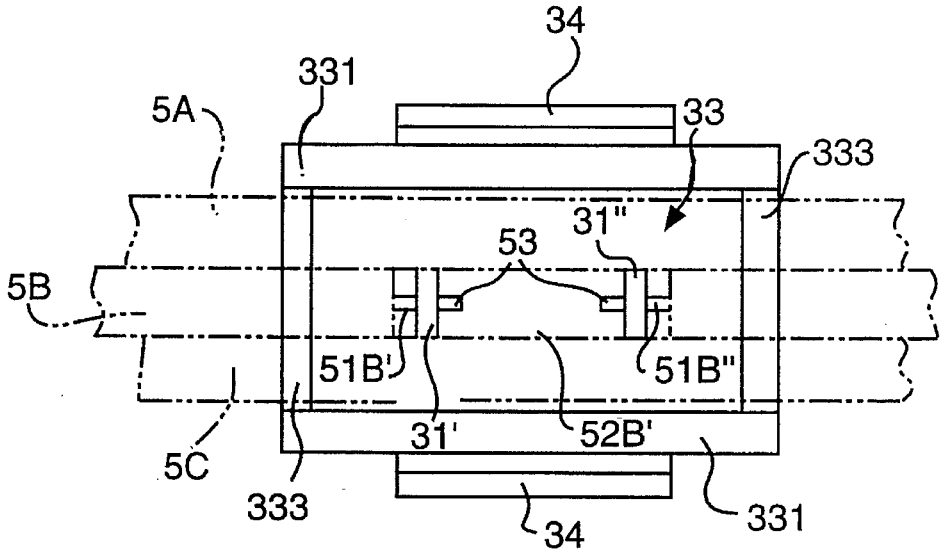

FIG. 17 is a top plan view of the wireway of a lampholder somewhat similar to FIG. 3, but depicting an alternative embodiment for connecting two lamps in series in which the wire is cut through.

Figure 18:
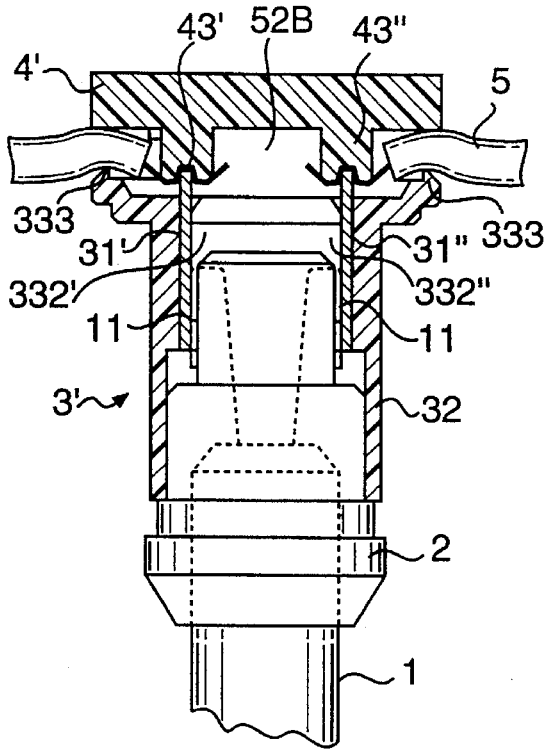

FIG. 18 is a side elevational view, partly in cross section, of the embodiment of the invention depicted in FIG. 17.

Figure 19:
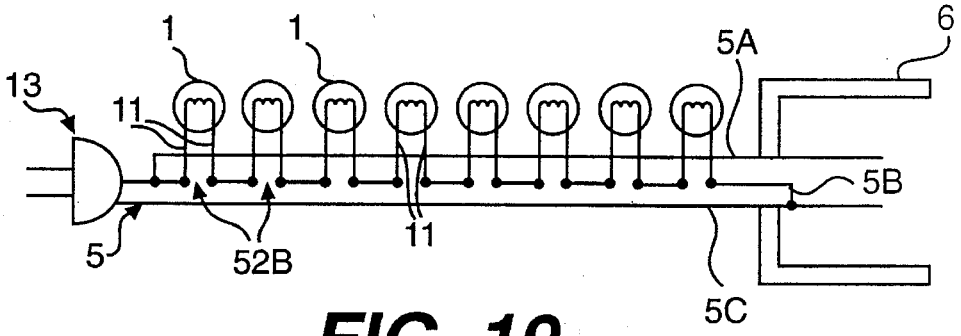

FIG. 19 is a second alternative embodiment of the electrical schematic of the circuitry depicted in FIG. 7 depicting a serial connection of the lamps.

Figure 20:
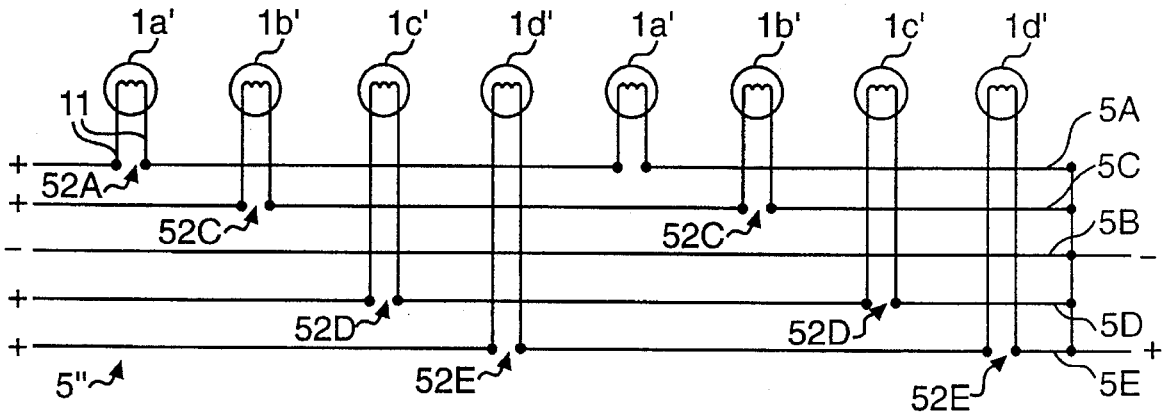

FIG. 20 is a third alternative embodiment of the electrical schematic of the circuitry depicted in FIG. 7 depicting a different serial and parallel connection of the lamps using a five wire cord.

DETAILED DESCRIPTION OF THE PREFERRED EMBODIMENTS

Figure 1:
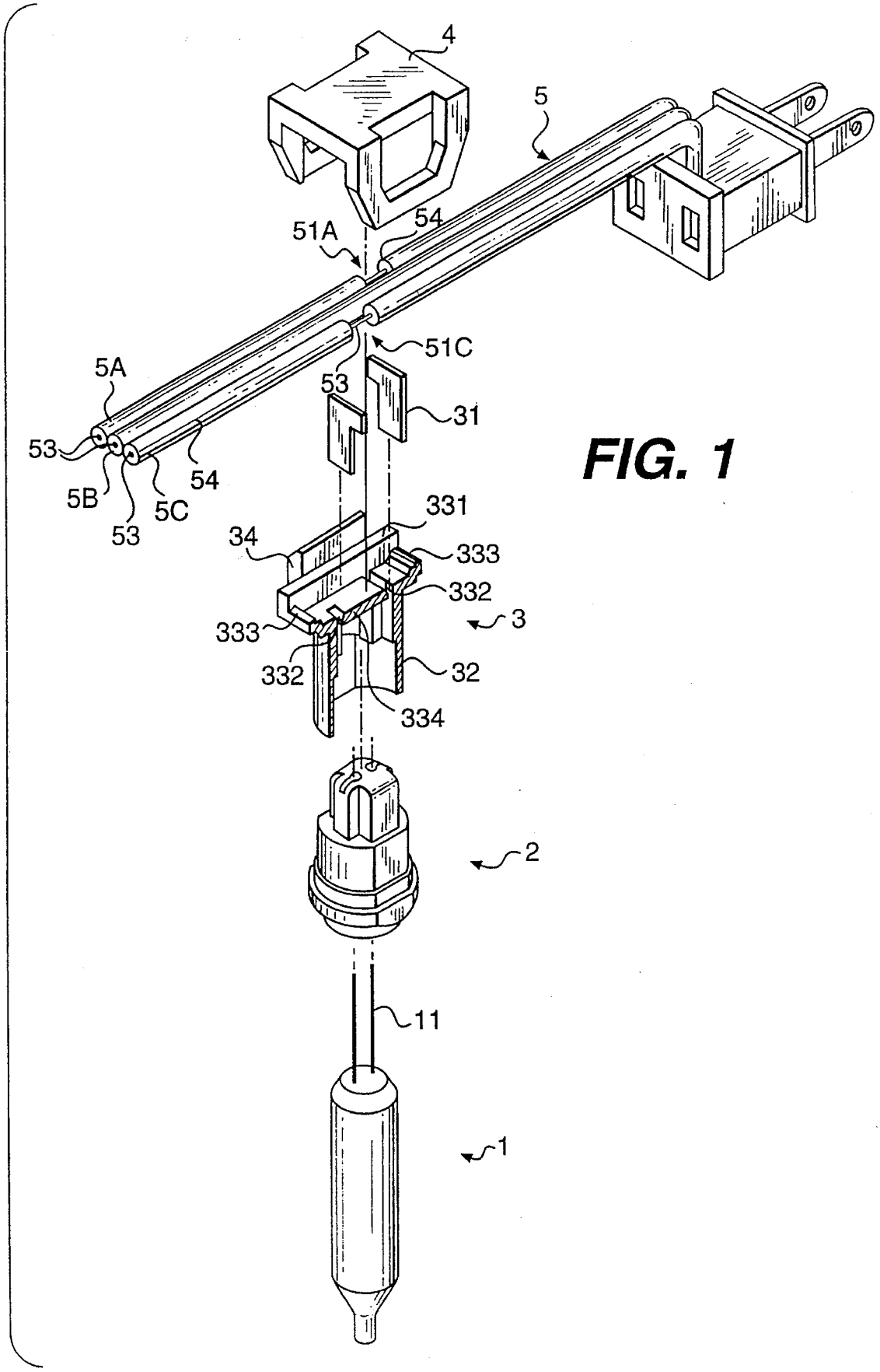
FIG. 1 is a three-dimensional, exploded perspective view, partially in section, of the present invention.

With reference now to the figures in which like elements are denoted by the same numeral, and in particular with reference to FIG. 1, a light set in accordance with the present invention is depicted. The light set is comprised of a plurality of lamps 1, each mounted in a socket 2, which in turn is mounted in a lampholder 3. A cover 4 is provided for each lampholders 3 so that a ribbon cord 5 can be mounted on the top of lampholder 3. Each lamp 1 is conventional and includes 2 wires 11 which extend through socket 2 when lamp 1 is mounted therein.

Figure 2:
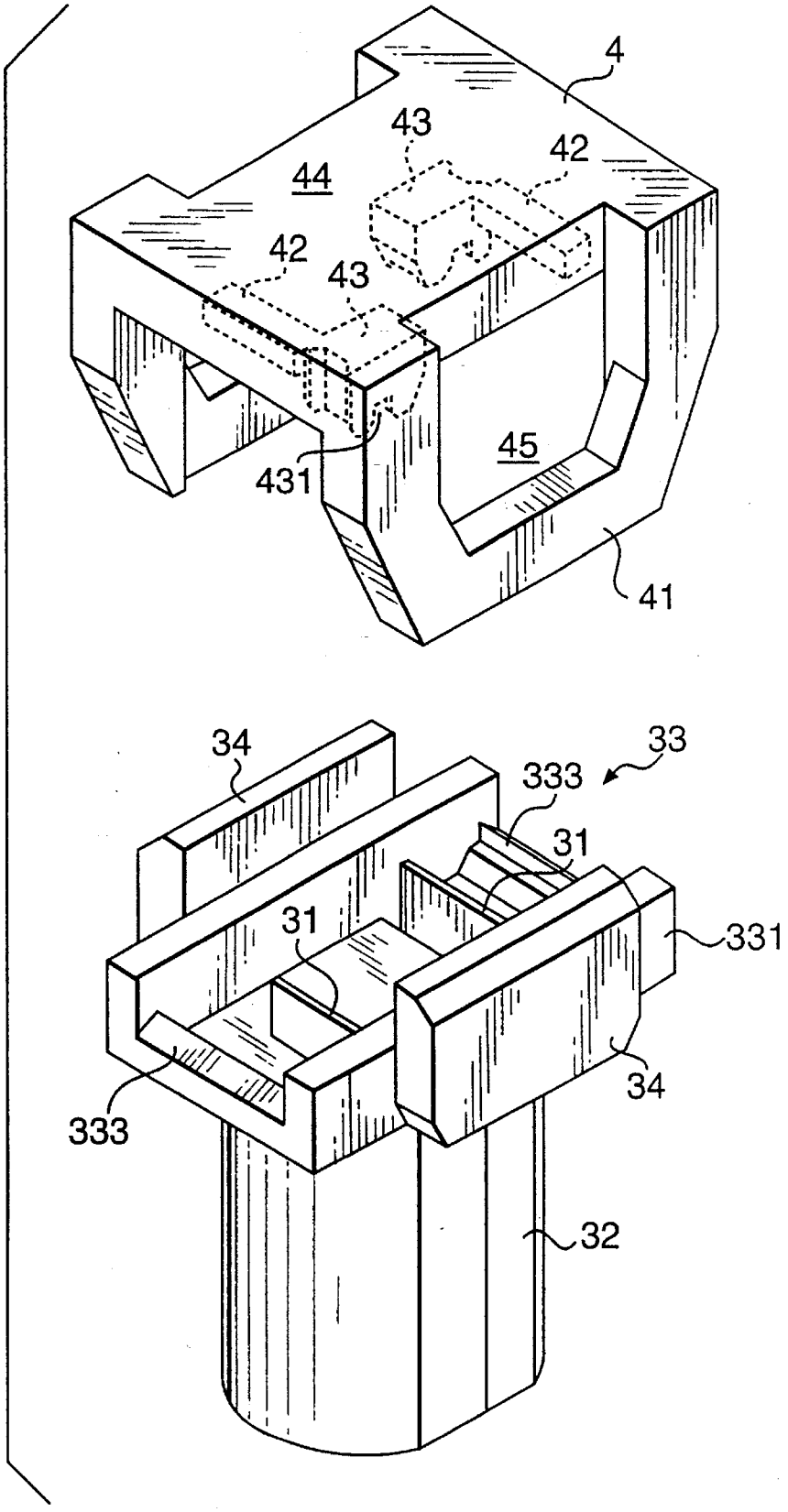
FIG. 2 is an exploded perspective view of the lampholder and snap-on cover.

Lampholder 3 is comprised of a lower housing 32 and an upper wireway 33 (see FIG. 2). Lampholder 3 is preferably made of an insulating material, such as a plastic material. Wireway 33 is adapted to receive a cord 5, which in the preferred embodiment is comprised of three coplanar wires, an outer wire 5A, a central wire 5B, and an outer wire 5C. Each wire 5A, 5B and 5C is comprised of a central conductor 53 and an outer sheath of insulation 54. When cord 5 is comprised of three coplanar wires, it is sometimes called a three-wire ribbon cord.

Outer wires 5A and 5C have stripped portions 51A and 51C, respectively, in which a portion of insulation 54 has been removed so as to expose conductor 53. Stripped portions 51A and 51C are longitudinally located on wireway 33 and staggered so that no part of stripped portions 51A and 51C overlap. In addition, as explained hereinbelow, in FIG. 3 wire 5A is shown with a cutout 52A located within wireway 33.

Wireway 33 is comprised of two elongated, spaced apart, parallel upstanding walls 331 connected together by a base 334. Two transversely extending pressing bars 333 extend upwardly to a suitable height from and are perpendicular to base 334. Pressing bars 333 have two planar sides and are connected at each end to the two walls 331. Base 334 has two vertically extending cavities 332 therein. A metal, elongate conductor plate 31 having an inverted "L" shape is received and retained in each cavity 332 and extend from a position just above base 334 downwardly into housing component 32. Rigidly mounted on the outside of each wall 331 is a solid coupling lug 34 that is provided with parallel planar sides and a beveled bottom. Each lug 34 is shorter than its corresponding wall 331, and is centered longitudinally on it, but extends above it. Lugs 34 are located directly opposite each other on wireway 33 and are configured and located so as to retain a snap-on cover 4 that can be removeably mounted on wireway 33.

As depicted more clearly in FIG. 2, snap-on cover 4 has an overall inverted U-shape and includes a base 44 and depending arms 41 on each side of base 44. Mounted on the lower surface of base 44 are two transversely extending press bars 42 and two longitudinally extending press bits 43. Each cover arm 41 is provided with a relatively large central opening 45 that has a size and shape so as to permit arms 41 to fit over and closely engage lugs 34. Alternatively, cover 4 could be hinged along one side edge to wireway 33 and include a latching means to securely hold cover 4 in a closed, engaging position. In another embodiment, cover 4 could slide into place along rails that are mounted on wireway 33.

As particularly shown in FIG. 6, press bars 42 are aligned and have a size and shape so as to be accommodated in the space between pressing bars 333 when cover 4 is mounted on wireway 33 and to depend into the space defined by walls, but their lower ends terminate above the top of pressing bars 333. Further, press bars 42 do not extend transversely all the way between walls 331. Press bits 43 are formed with a cavity or recess 431 in the lower end thereof which extends in the transverse direction. Press bits and recess 431 have a location on cover 4 so as to mate with the upper end of conductor plate 31. The spacing between recess 431 and conductor plate 31 when cover 4 is in place on wireway 33 is smaller than the size of the wire, and preferably slightly smaller than the size of central conductor 53. In this way, conductor portion 53 of the wire can contact the top end of conductor plate 31 when cover 4 is mounted on wireway 33. Thus, when cover 4 is mounted on wireway 33, the stripped portion 51A or 51C of wires 5A and 5C respectively are forced to bend in conformity with the cavity recess and thereby provide a better electrical contact between conductor plate 31 and stripped portion 51A.

In an alternative embodiment, as depicted in FIG. 6*a*, the lower end of press bits 43' has a flat profile and the spacing or clearance between the terminal ends of conductor plate 31 and press bits 43' is slightly smaller than the diameter of the conductor portion 53 of wire. The advantage of this embodiment is that it allows for a slight misalignment between the contact portion of press bit 43' and the top of conductor plate 31. However, the mechanical contact between conductor 53 and conductor plate 31 is not as good as the cavity embodiment depicted in FIG. 6 and this alternative embodiment requires that the pressure exerted by press bit 43' be greater, constant, and more reliable.

As seen in FIG. 3, stripped portions 5A and 5C are located along cord 5 such that when cord 5 is mounted within wireway 33, the exposed conductors 53 contact the tops of conductor plates 31. The cutouts 52A or 52C of wire 5A or 5C respectively are located inside lampholder 3 somewhere between pressing bars 333.

Figure 4:
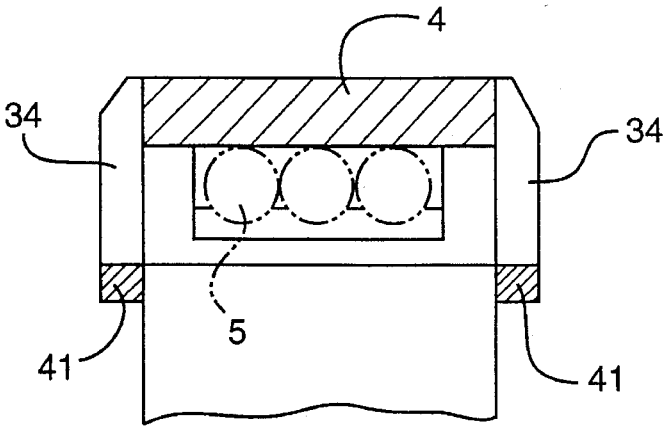
FIG. 4 is a side elevational view, partly in cross-section of an assembled lampholder and cover depicted in FIG. 2 depicting in phantom a ribbon cord having three wires.

Thus, when cord 5 is mounted in wireway 33 of lampholder 3 and cover 4 is applied, the application pressure on cover 4 will force the conductors of wires 5A and 5C into good electrical contact with conductor plates 31. Cover 4 is held in place by cover arms 41 engaging lugs 34. See also FIG. 4. Also as cover 4 and lampholder 3 are combined, stripped portions 51A and 51C of wires located above conductor plate 31 are compressed by press bit 43 of cover 4 and will bend to conform with cavity 431, as shown in FIG. 6, and thereby will provide a tightened contact with conductor plate 31 to make a physically secure and electrically tight circuit.

In addition, the bottom ends of press bit on either side of cavity 431 are a flat or planar surfaces so that when cover 4 is mounted on lampholder 3, these surfaces bring additional pressure on the exposed conductor 53 of cord 5.

It is noted that as cover 4 is being installed on lampholder 3, press bar 42 bends the corresponding wire because the lower end of press bar 42 extends to a height that is below the top end of pressing bar 333. This bending provides physical security against an axial pull on cord 5 as cord 5 is tightly locked and retained in wireway 33. In this way the axial position of lampholder 3 along cord 5 can be maintained.

Figure 5:
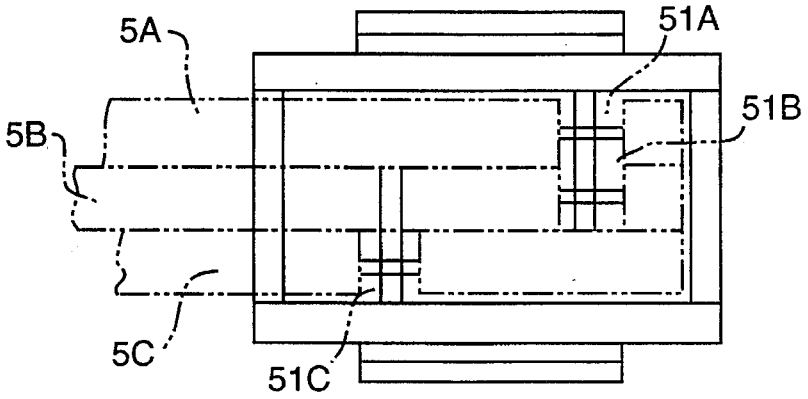
FIG. 5 is a top plan view of the wireway, similar to FIG. 3, but depicting in phantom the wiring arrangement of the terminal or last lampholder in a parallel subassembly.

So far the present invention has been described with respect to the mounting connections between lampholder 3 and cord 5. Now, one embodiment of a circuit for a light set according to the present invention will be described with respect to FIG. 7. The light set depicted in FIG. 7 is comprised of a plurality of parallel mountings or segments "a," "b," "c," "d," . . . , and "n" connected together in series. A plurality of lamps 1 are connected with wire leads 11 to each parallel segment or subassembly, which in the present embodiment is four lamps. Thus, wire leads 11 of each lamp 1 are respectively connected to wires 5A and 5C and each parallel subassembly is connected in series with the next subassembly by means of wires 5A or 5C such that wires 5A or 5C will have alternating cutouts 52A and 52C at intervals of every four lamps 1. Power then is supplied from wire 5C to a first parallel subassembly "a" with four lamps 1 to wire 5A through each of those four lamps 1; from wire 5A to the second parallel subassembly "b" and then through each of the four lamps of that subassembly to wire 5C; then to subassembly "c" in the same manner; and so forth repeating this sequence all the way through the last parallel lampholder subassembly "n" and terminating on wire 5B to complete the entire closed circuitry. In the last parallel subassembly "n," a connection between wire 5A or 5C to 5B is preferably duplicated in more than just the last lampholder. For example, in the embodiment depicted in FIG. 7, the connection is between wire 5A and 5B and is duplicated in the last two lampholders. As shown in FIG. 5, it can be seen that the connection between wires 5A and 5B is accomplished with conductor plate 31 being in physical contact with and electrically connecting stripped portion 51B to stripped portion 51A.

As can be seen in the circuitry of FIG. 7, one of the features of the present invention is that should any one lampholder 3 fail or should any lamp 1 drop out or burn out or otherwise fail, the remainder of the circuit will still be supplied with power and the lights illuminated by way of the other three lamps 1 of the affected parallel subassembly. Thus the shortcomings associated with the aforementioned conventional series wiring circuitry which becomes totally inoperative under similar circumstances. Similarly, because the last parallel subassembly "n" is designed to have wire 5A or 5C connected to wire 5B through more than just one lampholder, the integrity of the entire set is maintained such that the failure of any one lamp 1 or lampholder 3 will not cause the failure of any other part of the system.

Another safety feature of the present invention is seen with reference to FIG. 3. Cutouts 52A or 52C of wire 5A or 5C respectively are located inside lampholder 3 somewhere between pressing bars 333 rather than outside the lampholder where the cutout would be exposed. Such exposure would be harmful to the integrity of the system and even affect the safety considerations of the entire light set.

With reference now to FIGS. 9 through 16, a machine for automatically removing a selected amount of insulation only from one wire and for cutting a particular wire of cord 5 will now be described. In particular, with reference to FIGS. 9 and 10, a first station 601 of a multi-station apparatus for stripping and cutting selected wires of a multiwire ribbon cord 5 is depicted.

First station 601 includes an elongate housing 603 having a channel 605 therethrough. Mounted on each end of channel 605 are a first clamp 607 and a second clamp 609. Each clamp includes a lower base 611 which includes a wireway 613 through which a cord 5 can be fed, an automatically, remotely controlled actuator 615, and a press head 617 which can be moved into a restraining contact with cord 5 by actuator 615.

First station also includes an upper tool holder 619 holding two upper dividing blades 621 and 623 and a lower tool holder 625 holding two lower dividing blades 627 and 629. An upper tool holder actuator 631 controls the vertical position of upper tool holder 619 and a lower tool holder actuator 633 controls the vertical position of lower tool holder 625. Dividing blades 621, 623, 627 and 629 have a longitudinal length in the direction that cord 5 is pulled) that is equal to the length of stripped portion 51 and are transversely spaced apart a relatively small distance which is equal to the thickness of a wire in cord 5. A cord pulling device (not shown) can accurately pull cord 5 a predetermined distance such that a selected portion of cord 5 having a wire to be stripped can be positioned between the two sets of dividing blades 621 and 623, and 627 and 629. As shown in FIG. 10, the wires of cord 5 are separated from one another in a region equal to the length of the dividing blades when actuators force the dividing blades together.

In FIGS. 11, 13 and 15, a second station 641, a third station 643 and a fourth station 645 are respectively depicted. Each of the four stations are similar in that the clamps, actuators, and housing are similar. Therefor, the same numerals as used in FIG. 9 will be used in these figures. The principal difference between the stations is the type of tool in tool holders 619 and 625.

In second station 641, upper tool holder 619 holds two spaced apart blades 651 and 653 and lower tool holder 625 holds two spaced apart blades 655 and 657. Each of blades 651, 653, 655, and 657 is oriented perpendicular to cord 5 and each has a semicircular notch 659 bordered on each side by flat portions 661 and 663 (see FIGS. 12 and **12*a*). The diameter of notch 659 is approximately equal to, but slightly larger than, the diameter of conductor 53. The spacing between blade sets 651 and 653, and 655 and 657 is equal to the axial length of stripped portion 51**.

In third station 643, upper tool holder 619 holds a single, longitudinally oriented blade 671 and lower tool holder 625 hold an anvil 673. The length of blade 671 equals the length of stripped portion 51. FIG. 14 depicts blade 671 in a slitting position on wire 5B as anvil 673 holds wire 5B in place.

In fourth station 645, upper tool holder 619 holds a pusher bar 681 having a transversely oriented, U-shaped notch 683 in the leading edge thereof. The width of notch 683 is about equal to the diameter of conductor 53 and the axial length of pusher bar 681 is approximately equal to the length of stripped portion 51. In fourth station 645 as depicted in FIG. 15, there is no lower tool holder, it having been replaced by a supporting block 683. Obviously, supporting block 683 can itself be replaced by a smaller embodiment thereof which is retained by lower tool holder 625. Supporting block 683 has an open middle section 685 so that cord 5 will have a flexibility as the cut section of insulation 54 is pushed down as shown in FIGS. 16*a* and 16*b*. In this way, the risk of breaking or bending conductor 53 is minimized.

Although the stripping device has been shown as having four stations, a further embodiment could have only one station and an upper and lower tool holder that is essentially a carousel holding the various tools for the operations of dividing, circular insulation cutting, and longitudinal insulation cutting, which operations can be performed in any order, and insulation removal, which operation obviously must be the last one. In addition, the foregoing description was directed to center wire 5B, but the outer wires 5A and 5C can be operated on simply by having a tool holder that can be transversely moved by actuators 631 and 633.

A further embodiment of the circuit depicted in FIG. 7 is depicted in FIG. 8. A ribbon cord 5' is comprised of four wires, 5A, 5B, 5C and 5D. This embodiment permits the installation of a socket 6 after the last subassembly "n" in the light set so that another light set can be connected.

With reference now to FIGS. 17 and 18, there is depicted an embodiment of a lampholder 3' and cover 4' that can be used in serial connections between adjacent lampholders. In this embodiment, press bits 43' and 43" are rigidly, collinearly mounted on the underside of cover 4' and cavities 332' and 332" are collinearly aligned in wireway 33'. Thus, as seen in FIG. 17, conductor plates 31' and 31", respectively mounted inside cavities 332' and 332", are collinearly aligned to engage central wire 5B. Central conductor 53 of central wire 5B has a cutout 52B therein located in the space within wireway 33 between cavities 332' and 332". Press bits 43' and 43" respectively engage stripped portions 51B' and 51B" and mechanically force them into respective physical and electrical contact with conductor plates 51' and 51".

A further embodiment of a circuit for a lamp set according to the present invention which is made possible by the modified lampholder 3' and cover 4' is depicted in FIG. 19. The lamp set includes a three wire ribbon cord 5 and a plurality of series connected lamps 1 which together form a string of lights. Cord 5 includes wires 5A, 5B and 5C. Wires 5B and 5C are connected to a conventional plug 13 on a first end of cord 5 and wires 5A and 5C connected to a socket 6 on the other end of cord 5. The free end of wire 5A at the first end of cord 5 is connected to the end of wire 5B and the free end of wire 5B at the other end of cord 5 is connected to the end of wire 5C. The series connection results from cutouts 52B in conductor 5B which are located between the connection of conductor 5B to lamp wires 11.

The use of a three wire ribbon cord 5 makes it possible to have a parallel-series connection of a plurality of lamps in the lamp set by connecting a second string of series connected lamps to plug 6. If this feature is not desired, then wire 5A can be eliminated.

In FIG. 20 there is depicted yet another embodiment of a circuit made possible by the embodiment of lampholder 3' of FIG. 18. In this circuit, a ribbon cord 5" is comprised of 5 wires, four active or positive wires 5A, 5B, 5D and 5E and a neutral wire 5C, sometimes called a return wire or a negative wire. The four active wires are connected in parallel to each other and to the hot line of a plug (not shown) located at a first end of cord 5". All five wires are connected to each other at the other end of cord 5". In addition, wires 5C and 5E continue beyond the connection at the other end of cord 5" to a socket (not shown) so that further strings can be added.

Each of the four active wires 5A, 5B, 5D and 5E have a plurality of series connected lamps 1 connected to them, but the lamps of each active wire are interspaced along cord 5. This creates four parallel groups of lamps, 1*a'*, 1*b'*, 1*c'* and 1*d'*. As in the series connection of the circuit embodiment depicted in FIG. 19, the series connection results from cutouts 52A, 52B, 52D and 52E in conductors 5A, 5B, 5D and 5E, respectively, which are located between the connection of the respective conductors to lamp wires 11.

In summary, the present invention functions essentially by mounting the unique lampholder and cover of the present invention on a multiwire ribbon cord and securely, physically coupling stripped sections of the wires with a plurality of press bits forcing the bare conductor into contact with a conductor plate. In one particular embodiment, the press bits are rigidly mounted on the underside of a snap-on cover that mounts over a wireway located at one end of a lampholder. A plurality of pressing bars furnished in the wireway of a lampholder in combination with press bars mounted on the underside of the snap-on cover to ensure that the cord in the wireway is reliably secured in position. The lampholder of the present invention can be configured to provide a parallel connection of a lamp to two wires of a cord or to provide a series connection of a lamp to one wire of a cord.

The circuit to make a closed loop utilizes the wire leads on either end of the lamp to make contact with wires 5A and 5C. The circuit of each subassembly of parallel lampholders is created by alternately, selectably severing portions of the cord wires. The parallel-series circuit thereby formed provides security through redundancy to the effect that should any one lampholder or lamp fail, the normal functioning of the other lamps will not be affected.

A design such as that of the present invention has thus been demonstrated to be more advantageous with respect to the functional performance than any known conventional design of miniature light sets. Other modifications, changes and embodiments of the present invention would be obvious to those skilled in the art with reference to the attached claims.

I claim:

1. A light set comprising a cord having at least two wires, each wire comprised of a conductor and an insulation surrounding said conductor, two portions of said wires wherein in each said portion a part of said insulation is missing so as to expose said conductor;

a plurality of lampholders having two ends, each lampholder comprised of:

a longitudinal wireway at one end to receive a section of at least one wire of said cord, a housing to receive a lamp at the other end, and two conductor pieces located in said wireway, each said conductor piece having a first end portion extending into said housing and in electrical contact with a lamp when a lamp is received by said lampholder, and a second end portion accessible from said wireway, said exposed conductors in said wire portions being located in said wireway so as to make physical contact with said conductor pieces; and means for urging said conductor pieces and said exposed conductors into physical contact with each other.

2. A light set as claimed in claim 1, wherein all of said lampholders in said light set are connected to said cord to form a linear assembly, and wherein said light set has a plurality of sub-assemblies of linearly arranged lampholders, including a first sub-assembly and a last sub-assembly, all of the linearly arranged lampholders in each sub-assembly being electrically connected in parallel, a sub-assembly being designated either an odd numbered sub-assembly or an even numbered sub-assembly;

wherein one of said at least two wires has a cut-out portion so as to create an electrical discontinuity in every odd numbered sub-assembly; and wherein the other of said at least two wires has a cut-out portion so as to create an electrical discontinuity in every even numbered sub-assembly, such that said two wires have alternating cut-outs in adjacent sub-assemblies, and the wire not having a cut-out portion in a sub-assembly forms a series connection with an adjacent following sub-assembly.

3. A light set as claimed in claim 2, wherein said cord has at least a third wire, said third wire being comprised of a conductor and an insulation surrounding said conductor; and wherein said third wire has a portion of said insulation removed to form a stripped portion of said conductor in at least one of the lampholders in the last sub-assembly of said light set; and wherein said conductor piece electrically connects the stripped portion of either said one or said other of said at least two wires with the stripped portion of said third wire.

4. A light set as claimed in claim 3, wherein all of said lampholders in said light set are connected to said cord to form a linear assembly having a first lampholder and a last lampholder;

wherein said cord includes another wire electrically connectable at one end to one line of a power source; and said light set further includes a socket electrically connected to said last lampholder and to the other end of said another wire.

5. In a miniature light set which includes a cord and a plurality of miniature light lamps and a plurality of lampholders mounted along the cord such that there is a first and a last lampholder in the light set cord, each lampholder having an upper part for receiving the cord and a lower part for receiving a lamp, each cord being comprised of a plurality of wires and each said wire having a central conductor that has a diameter and is surrounded by a sheath of insulation, the improvement comprising:

a wireway located in the upper part of the lampholder, said wireway comprising an elongate central channel formed by a central base having two sides and two ends and two upstanding walls mounted to the sides of said base, a transverse, upstanding pressing bar having a top surface and mounted at each end of said base, two longitudinally spaced apart cavity recesses located between said pressing bars, and said wireway further including a conductor plate mounted in each said recess and having a terminal end; and a snap-on cover with depending press bars having a bottom surface and a depending press bit having a bottom surface projecting downwardly underneath said cover, said press bars extending into said wireway channel between said pressing bars when said cover is mounted on said wireway such that the bottom surfaces of said press bars extend to a level that is below the top surfaces of the pressing bars, the bottom surface of said press bit being aligned with said conductor plates, but spaced therefrom when said cover is mounted on said wireway;

said cord being located in said wireway channel, and a first and a second of said wires having a portion of said insulation stripped off at a location corresponding to said conductor plates.

6. A miniature light set as claimed in claim 5, wherein the bottom surface of said press bit has a cavity recess therein which is aligned with said conductor plates; and wherein the conductor portion left naked by the stripped portion of the wire located above the conductor plates, being acted upon by the press bit of the snap-on cover, is forced to bend in conformity with said cavity recess when engaged by the conductor plates.

7. A miniature light set as claimed in claim 5, wherein the bottom surface of said press bit as part of the snap-on cover has a flat profile, and when the cover is mounted on said wireway there is a spacing between said press bit bottom surface and said terminal end of said conductor plate which is slightly smaller than the diameter of the conductor portion.

8. A miniature light set as claimed in claim 5, wherein the press bar that is part of the snap-on cover serves to compress the wire located between the two pressing bars of the lampholder so as to bend the wire.

9. A miniature light set as claimed in claim 5, wherein at least one of said first and second wires forms alternating cut-outs limited between two parallel lampholder subassemblies, so that each parallel lamp assembly, by means of said first or second wire, forms a series connection with the next following parallel bulb mounting subassembly.

10. A miniature light set as claimed in claim 9, wherein each of said cut-outs of said at least one of said first and second wires lies in the space defined by both pressing bars of a lampholder.

11. A miniature light set as claimed in claim 5, wherein said lamp includes wire leads electrically connected to an end of the lamp and respectively, electrically connected to said first and second wires of the cord thereby forming a plurality of parallel lampholder subassemblies connected to the cord such that there is a first and a last lampholder subassembly.

12. A miniature light set as claimed in claim 11, wherein that one of said first and second wires which is connected to at least one lampholder forming part of the last parallel subassembly of said lampholder is connected to a third wire via a contact piece by way of the stripped area.

13. A miniature light set as claimed in claim 11, wherein at least one of said first and second wires forms alternating cut-outs limited between two parallel lampholder subassemblies, so that each parallel lamp assembly, by means of said first or second wire forms a series electrical connection with the next following parallel bulb mounting subassembly.

14. A miniature light set as claimed in claim 11, wherein the cord includes a third wire, and a portion of the third wire associated with at least one lampholder and as part of the last parallel subassembly of said lampholder correspondent with the conductor plate is stripped to form a stripped portion.

15. A miniature light set as claimed in claim 11, wherein the cord comprises a four-wire assembly and the last subassembly has a tail portion, and a socket is provided at the tail portion of the last parallel subassembly of said lampholder.

16. A miniature light set as claimed in claim 5, wherein the wireway walls each have an inside portion and an outside portion, and the outside portions of the walls of the wireway are formed as coupling hasps; and wherein the snap-on cover has "U" shaped bridges extending down on both sides thereof.

17. A light set which includes elongated lampholders for holding lamps and a cord that is comprised of at least two wires, each wire having a central conductor having a diameter surrounded by a sheath of insulation, the improvement comprising:

a wireway located at one end portion of the lampholder, said wireway comprising an elongated channel defined by a base, two longitudinally spaced apart cavity recesses located in said base, and a conductor plate mounted in each said recess; and a cover mountable on top of said wireway and having press bits projecting outwardly underneath said cover, each said press bit having an underside which has a contacting surface that is aligned with said conductor plates, but is spaced therefrom when said cover is mounted on said wireway;

said cord being located in said wireway channel and two said wires each having a portion of said insulation stripped off and exposing a stripped portion of said conductor at a location corresponding to said conductor plates such that when said cover is mounted on said wireway, said conductor stripped portion is engaged by said conductor plate and said press bit contacting surface.

18. A light set as claimed in claim 17, wherein said press bit contacting surface has a cavity recess therein which is defined by a top contacting surface and two side contacting surfaces, and which when said cover is mounted on said wireway is aligned with said conductor plates, but said top surface is spaced thereabove; and wherein when said cover is mounted on said wireway, said conductor stripped portion is engaged by said conductor plates and at least one of said press bit side and top contacting surfaces.

19. A light set as claimed in claim 18 wherein said conductor plate and said press bit are spaced apart a distance such that when said cover is being mounted on said wireway, said conductor stripped portion, being acted upon by said press bit and conductor plate, is forced to bend in conformity with said press bit cavity recess when said conductor stripped portion is engaged by a corresponding said conductor plate.

20. A miniature light set as claimed in claim 18, wherein the underside of said press bit has a planar portion on either side of said cavity recess, and the spacing between said conductor plate and said press bit when said cover is installed is slightly smaller than the diameter of said conductor.

21. A miniature light set as claimed in claim 17, wherein said press bit contacting surface is planar.

22. A miniature light set as claimed in claim 17, wherein said wireway further includes a transverse, upstanding pressing bar having an upper end and mounted at a corresponding end of said base; and wherein said cover further includes two press bars having lower ends, each press bar when said cover is mounted on said wireway extending into said wireway channel adjacent a corresponding pressing bars such that said lower ends of said press bars extend to a level that is below the upper ends of said pressing bars so as to compress the cord between said pressing bars and said press bars causing the cord to bend.

23. A light set as claimed in claim 17, wherein all of said lampholders in said light set are connected to said cord to form a linear assembly, and wherein said light set has a plurality of sub-assemblies of linearly arranged lampholders, including a first sub-assembly and a last sub-assembly, all of the linearly arranged lampholders in each sub-assembly being electrically connected in parallel and all of the sub-assemblies being electrically connected in series.

24. A light set as claimed in claim 17, wherein said cord has at least a third wire, said third wire being comprised of a conductor and an insulation surrounding said conductor; and wherein said third wire has a portion of said insulation removed to form a stripped portion of said conductor in at least one of the lampholders; and wherein one of said conductor plates electrically connects the stripped portion of one of said two wires with the stripped portion of said third wire.

25. A light set as claimed in claim 24 and further including an electrical plug which can be inserted into an electrical outlet, said plug having a first plug wire and a second plug wire; and wherein said third wire is electrically connected to said first plug wire and one of said two wires is electrically connected to said second plug wire.

26. A light set as claimed in claim 25 wherein said cord has a fourth wire; and said light set further comprising an electrical socket, said electrical socket having a first socket wire and a second socket wire; and wherein said first socket wire is electrically connected to said third wire and said second socket wire is electrically connected to said fourth wire.

27. A light set as claimed in claim 17, wherein said one end portion of said lampholder includes two longitudinally extending, transversely spaced apart, upstanding walls, each of which has an inner side and an outer side, said inner sides defining said wireway therebetween, and said outer side having lugs mounted thereon;

and wherein said cover is a snap-on cover having a top and two depending sides, each side having a generally U-shape such that said depending sides can engage said lampholder lugs.

28. A light set comprising a cord comprised of two wires, each of said wires comprised of a conductor and an insulation surrounding said conductor, and at least one of said at least two wires having part of said insulation removed at a plurality of locations to form stripped portions of said conductor, and having a cut-out portion between said stripped portions;

a plurality of lampholders having two ends, each lampholder comprised of:

a longitudinal wireway at one end to receive a portion of said cord, a housing to receive a lamp at the other end, and two conductor pieces located in said wireway, each said conductor piece having a first end portion extending into said housing and in electrical contact with a lamp when held by said lampholder, and a second end portion accessible from said wireway, said wire stripped portions being located in said wireway so as to make physical contact with said conductor pieces and said cut-out portion being located between said conductor pieces; and means for urging said conductor pieces and said wire stripped portions into physical contact with each other.

29. A light set as claimed in claim 28, wherein all of said lampholders in said light set are connected to said one wire to form a linear assembly;

said light set further comprising a plug on one electrical end of said cord, said plug having two plug contacts, and a socket at the other end of said cord, said socket having two socket contacts, said other wire being electrically connected at one end to a first plug contact and being electrically connected at the other end to a first socket contact; and wherein said cord further includes a third wire connected at one end to said second plug contact and connected at the other end thereof to said second socket contact, and wherein said one wire is electrically connected at one end to said first plug contact and is electrically connected at the other end to said second socket contact.

30. A light set as claimed in claim 28, wherein said cord comprises at least three wires, a first and a second of said wires having part of said insulation removed at a plurality of locations to form stripped portions of said conductor and having a cut-out portion between said stripped portions; and wherein said lampholders are physically arranged along said cord in a linear assembly, one lampholder being connected to said one wire and the next lampholder being connected to said second wire such that said first and second wires each have a plurality of lampholders electrically connected in series and said first and second wire are connected in parallel to the third wire.

31. A light set comprising:

a plurality of lamps;

a plurality of lampholders, each lampholder having two ends and comprised of a longitudinal wireway at one end having at least one conductor piece located therein, said conductor piece having a first end portion extending into said housing in electrical contact with said lamp, and a housing at the other end, a lamp being mounted in said housing;

a cord comprised of at least three wires, each of said at least three wires comprised of a conductor and an insulation surrounding said conductor, and a first and a second end, a first and a second of said wires each having at least one cut-out portion so as to create an electrical discontinuity and to create at least a first and a second wire segment, a plurality of lampholders being mounted on said first and second wire segments of said first wire, said second wire being continuous between said first and second segments of said first wire, and a plurality of lampholders being mounted on said first and second wire segments of said second wire, said first wire being continuous between said first and second segments of said second wire, said conductor pieces electrically connecting corresponding ones of said lamps with said first or second wires, said cut-outs thereby defining a plurality of subassemblies of lampholders, each sub-assembly being electrically connected in series with an adjacent sub-assembly by the continuous one of said first or second wire, the lampholders in each said sub-assembly being electrically connected in parallel, and there being a first and a last sub-assembly of lampholders, and said third wire being uninterrupted and in electrical contact with a conductor piece in at least one lampholder in the last sub-assembly of lampholders, thereby completing a parallel-series circuit.

32. A lampholder having a socket for holding a lamp for a light set which light set includes a wire having a central conductor surrounded by a sheath of insulation, the improvement comprising:

a housing having an opening for receiving the wire;

a wireway located in said housing in communication with said opening and comprising a channel defined by a base, a first and a second conductor member respectively mounted in said base and each electrically connected to the socket, each said conductor member having a portion accessible from said wireway; and means for urging said conductor members and an exposed portion of the conductor into physical contact with each other.

33. A lampholder as claimed in claim 32 wherein said wireway further includes a first and a second mutually spaced apart cavity recess located in said base; and wherein said first and second conductor members are respectively mounted in said first and second recesses.

34. A lampholder as claimed in claim 32 wherein said urging means comprises a first and a second press bit, each said press bit having a contacting surface and located in said wireway respectively aligned with said first and second conductor members, each said press bit contacting surface being spaced above said respective conductor member a distance that is equal to or less than a diameter of said wire central conductor such that a stripped portion of said central conductor when located in said wireway channel is squeezed between said press bit contacting surface and said conductor member accessible portion.

35. A lampholder as claimed in claim 32 wherein said wireway further includes a first and a second mutually spaced apart cavity recess located in said base;

wherein said first and second conductor members are respectively mounted in said first and second recesses and extend into said wireway; and wherein said urging means comprises a first and a second press bit, each said press bit having a contacting surface and located in said wireway respectively aligned with said first and second conductor members, each said press bit contacting surface being spaced above said respective conductor member a distance that is equal to or less than a diameter of said wire central conductor such that a stripped portion of said central conductor when located in said wireway channel is squeezed between said press bit contacting surface and said conductor member accessible portion.

36. A lampholder as claimed in claim 32 and further including a cover mountable on and wireway, said press bits rigidly mounted to said cover such that when said cover is mounted on said wireway said press bits are respectively aligned with, but spaced from said conductor members.

37. A lampholder as claimed in claim 33 wherein said housing is elongate about a first axis and has two end portions, the socket being located at one housing end portion and said wireway being located at the other housing end portion; and wherein said channel extends along a second axis that is at least substantially perpendicular to said first axis.

38. A lampholder as claimed in claim 37 wherein said recesses extend transversely across said channel and are spaced apart in a direction of said second axis; and wherein said first recess extends from one side of said channel to a point spaced from the other side of said channel and said second recess extends from the other side of said channel to a point spaced from said one channel side such that one wire can extend in said channel past said first conductor member without contact therewith and a second wire can extend in said channel past said second conductor member without contact therewith.

39. A lampholder as claimed in claim 38 wherein said recesses extend transversely across said channel and are spaced apart in the direction of said second axis; and wherein said first and second conductor members both extend across one of said wires and can contact different stripped conductor portions of the same wire such that when the wire is mounted in said channel and has a cutout portion located between said conductor members, the socket is connected in series to another lampholder socket.

* * * * *